US009911558B2

(12) United States Patent
Haehnel et al.

(10) Patent No.: US 9,911,558 B2
(45) Date of Patent: Mar. 6, 2018

(54) SWITCH CONTACT CHAMBER SEAL

(71) Applicant: TE Connectivity Germany GmbH, Bensheim (DE)

(72) Inventors: Thomas Haehnel, Berlin (DE); Albert Koetter, Berlin (DE); Christian Maranke, Luechfeld (DE); Rene Wagner, Berlin (DE); Titus Ziegler, Berlin (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/944,824

(22) Filed: Nov. 18, 2015

(65) Prior Publication Data

US 2016/0071673 A1 Mar. 10, 2016

Related U.S. Application Data

(63) Continuation of application No. PCT/EP2014/060875, filed on May 27, 2014.

(30) Foreign Application Priority Data

May 31, 2013 (DE) ..... 10 2013 210 208

(51) Int. Cl.
*H01H 33/72* (2006.01)
*H01H 1/20* (2006.01)
(Continued)

(52) U.S. Cl.
CPC ..... *H01H 33/72* (2013.01); *H01H 9/042* (2013.01); *H01H 1/20* (2013.01); *H01H 73/045* (2013.01)

(58) Field of Classification Search
CPC ..... H01H 33/72; H01H 33/182; H01H 9/02; H01H 9/0246; H01H 9/042; H01H 9/04; H01H 3/00; F16M 1/00
(Continued)

(56) References Cited

U.S. PATENT DOCUMENTS 3,480,893 A * 11/1969 Sidor ..... H01H 51/287 335/202
4,265,365 A * 5/1981 Boteler ..... H02G 3/088 220/3.3
(Continued)

FOREIGN PATENT DOCUMENTS

CN 1521782 A 8/2004
CN 202711993 U 1/2013
(Continued)

OTHER PUBLICATIONS

Machine Translation DE9420291 (original document published Oct. 19, 1995).*
(Continued)

*Primary Examiner* — Truc Nguyen
*Assistant Examiner* — William Bolton
(74) *Attorney, Agent, or Firm* — Barley Snyder

(57) ABSTRACT

An electrical switch element is disclosed. The electrical switch element includes a housing having a switch chamber, an opening to the switch chamber, electrical switch contacts arranged in the switch chamber, and at least one positive-locking counter-element extending at least partially around the opening. The electrical switch element also includes a cover having at least one positive-locking element engaging the at least one positive-locking counter-element, the cover extending over the opening.

19 Claims, 6 Drawing Sheets

(51) Int. Cl.
*H01H 9/04* (2006.01)
*H01H 73/04* (2006.01)

(58) Field of Classification Search
USPC ..... 218/146, 68, 97, 134, 154–156; 335/71, 335/127, 133, 201, 202; 200/520
See application file for complete search history.

(56) References Cited

U.S. PATENT DOCUMENTS

| | | | | | |
|---|---|---|---|---|---|
| 4,322,702 | A | * | 3/1982 | Bosch | H01H 50/02 335/202 |
| 5,059,931 | A | * | 10/1991 | Lesslie | H01H 71/0207 335/132 |
| 5,164,561 | A | | 11/1992 | Schaeffeler et al. | |
| 5,440,284 | A | * | 8/1995 | Ferullo | H01H 71/501 335/202 |
| 5,741,149 | A | * | 4/1998 | Anthony | H01R 13/707 439/333 |
| 5,973,581 | A | | 10/1999 | Jacquin et al. | |

FOREIGN PATENT DOCUMENTS

| | | | | | |
|---|---|---|---|---|---|
| DE | 1170890 | B | | 5/1964 | |
| DE | 9420291 | U1 | | 11/1995 | |
| EP | 1445783 | | * | 8/2004 | H01H 3/00 |
| GB | 2197075 | A | | 5/1988 | |
| WO | 2011119176 | A1 | | 9/2011 | |
| WO | 2012088177 | A2 | | 6/2012 | |

OTHER PUBLICATIONS

PCT International Search Report, International Application No. PCT/EP2014/060875, dated Aug. 29, 2014, 4 pages.
Abstract of CN202711993, dated Jan. 30, 2013, 1 page.
European Search Report, dated Jan. 20, 2017, 4 pages.
English translation of Chinese Office Action, dated Dec. 23, 2016, 7 pages.
Chinese Office Action, dated Dec. 23, 2016, 5 pages.

* cited by examiner

SWITCH CONTACT CHAMBER SEAL

CROSS-REFERENCE TO RELATED APPLICATIONS

This application is a continuation of International Application No. PCT/EP2014/060875, filed May 27, 2014, which claims priority to German Application No., DE 10 2013 210 208, filed May 31, 2013.

FIELD OF THE INVENTION

The invention relates to an electrical switch element, and more particularly, to a switch element having a housing and a cover.

BACKGROUND

Electrical switch elements, such as relays or contactors, are known. When the switch contacts are opened, in particular in the event of high current strengths, electric arcs may be formed between the contacts. Electric arcs can prevent the electric switch from being interrupted, and the hot plasma generated by the arc can damage the components of the switch element.

Sealing the switch element mitigates damage by maintaining a high pressure generated in the switch chamber; the arc can be better extinguished than under atmospheric pressure. The sealing further has the advantage that the arc plasma, which has a temperature of several thousand degrees, does not reach and damage elements exterior of the switch chamber.

There are known pressure-tight switch contact chambers which are substantially formed by a base member or housing with a fixed contact arranged therein and a cover which is arranged at the side of the housing opposite the fixed contacts. In order to seal the cover with respect to the housing, two possibilities are known: soldering the cover to the housing, or integrally forming the housing and cover when casting the overall system. Consequently, the known possibilities for sealing the switch chamber, by requiring processes such as soldering and casting, are expensive and complex in terms of production.

SUMMARY

An object of the invention, among others, is to provide an electrical switch element having a switch chamber which can be sealed in the most simple and stable manner possible. The disclosed electrical switch element includes a housing having a switch chamber, an opening to the switch chamber, electrical switch contacts arranged in the switch chamber, and at least one positive-locking counter-element extending at least partially around the opening. The electrical switch element also includes a cover having at least one positive-locking element engaging the at least one positive-locking counter-element, the cover extending over the opening.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of an electrical switch contact chamber seal. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 5:
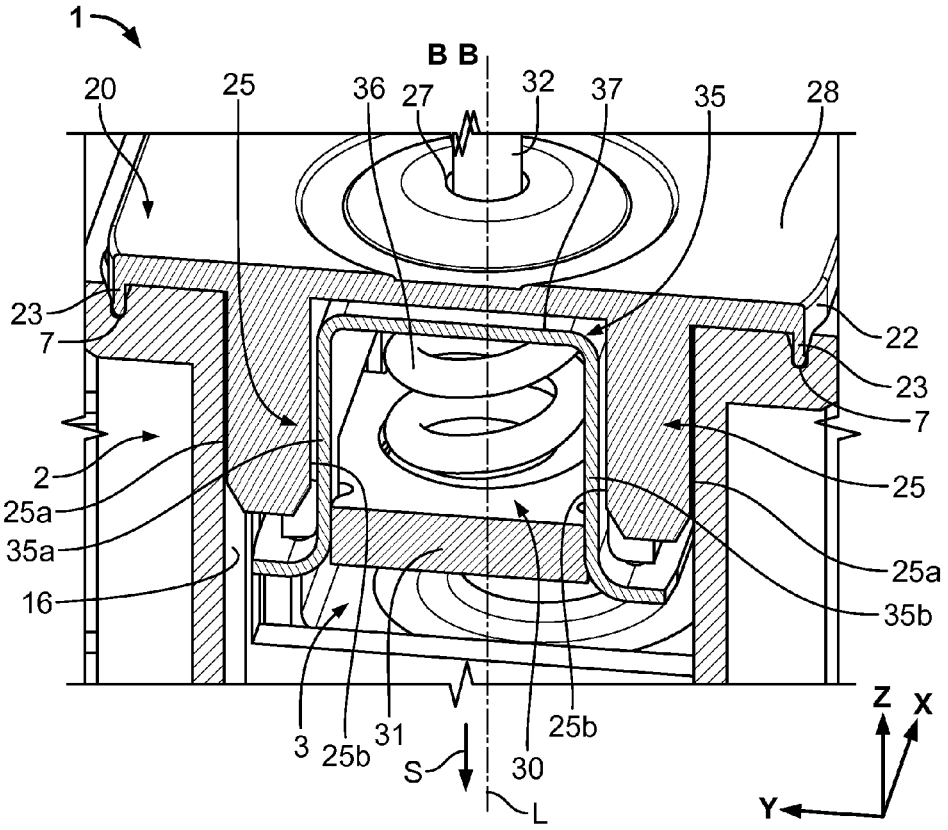
FIG. 5 is a cross-section of the housing shown in FIGS. 1 and 2 with the cover shown in FIG. 3, taken along the line of section B-B shown in FIG. 2.
Figure 7:
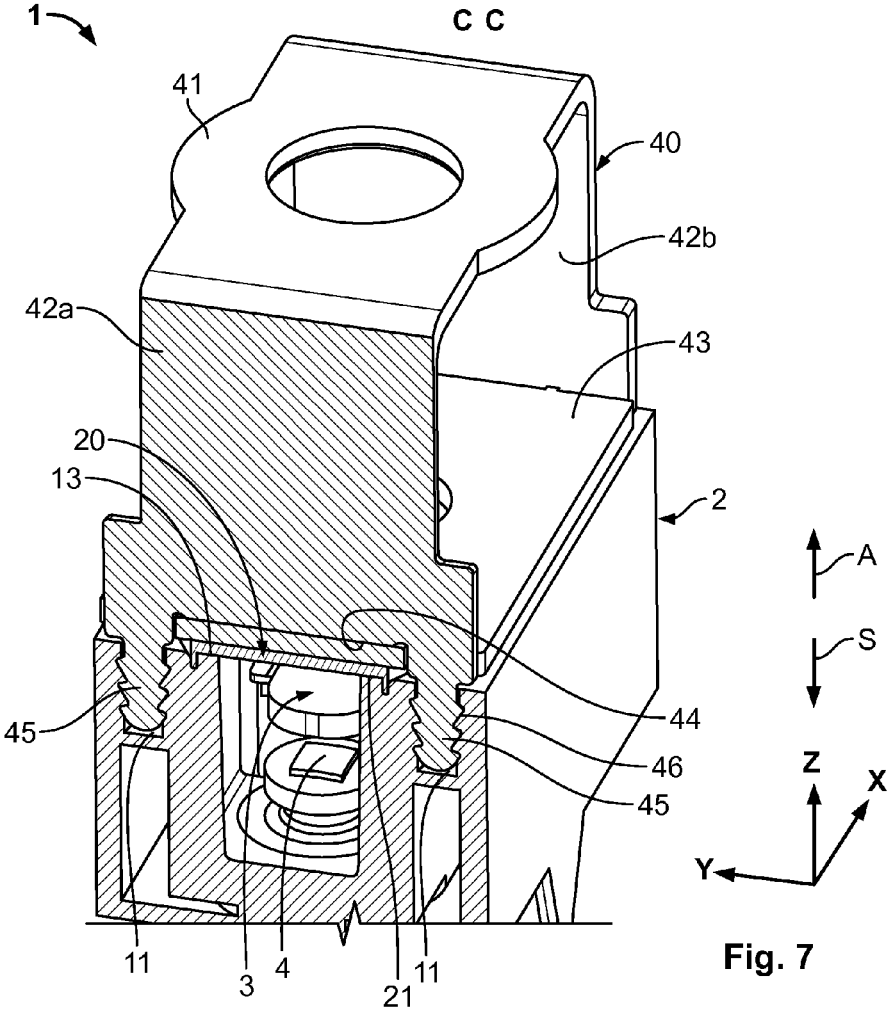
FIG. 7 is a cross-section of the housing shown in FIGS. 1 and 2, the cover shown in FIG. 3, and a portion of a drive system for an electrical switch element according to the invention, taken along the line of section C-C shown in FIG. 2.

The electrical switch element 1 of the invention is shown in FIGS. 5 and 7. The electrical switch element includes a housing 2, a cover 20, a switch contact subassembly 30, and a drive device 40. The major components of the invention will now be described in greater detail.

Figure 1:
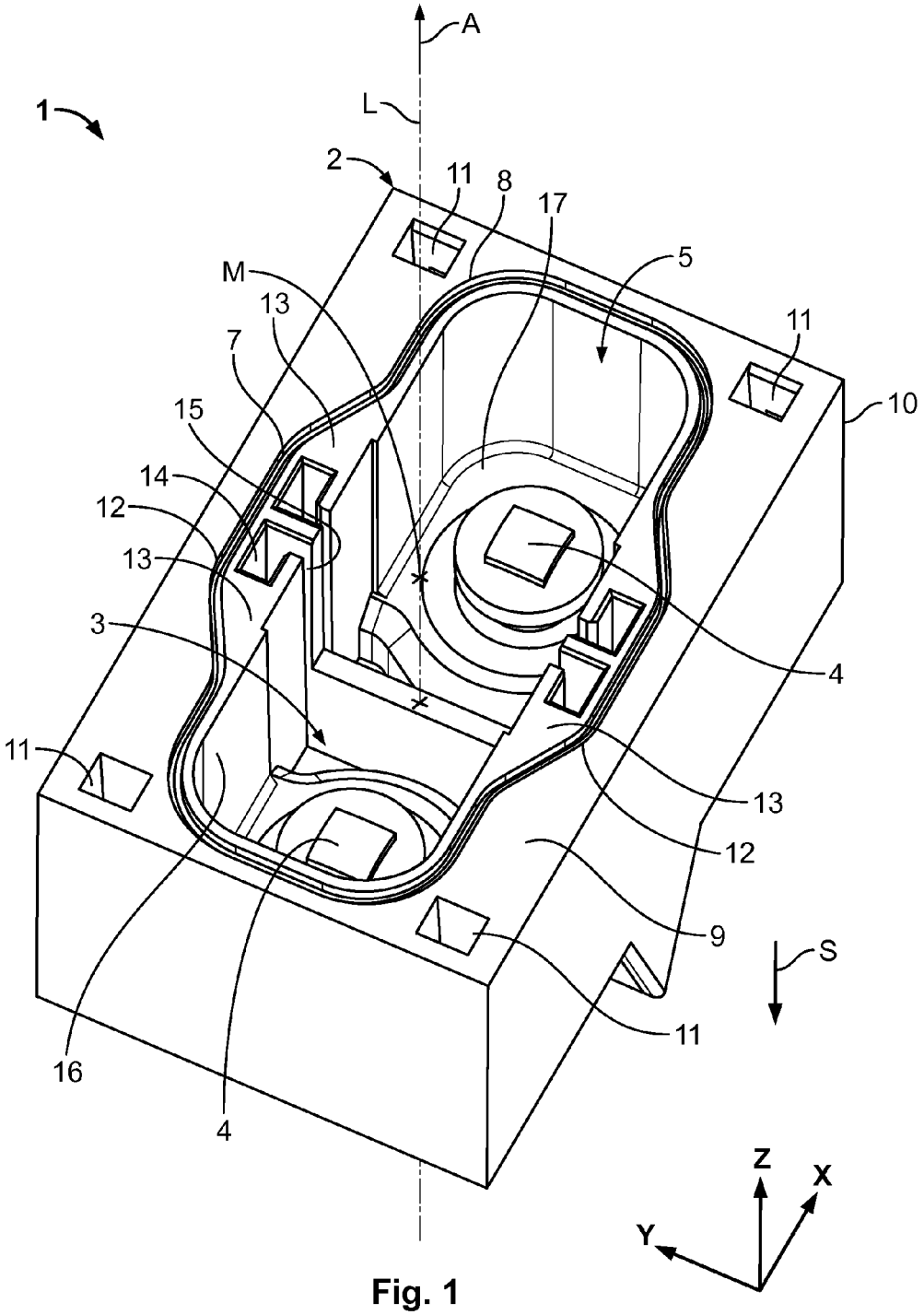
FIG. 1 is a perspective view of a housing for an electrical switch element according to the invention.

The housing 2, first described with reference to FIG. 1, forms a switch chamber 3 in which electrical switch contacts 4 are arranged. The switch chamber 3 is accessible via an opening 5. In the present embodiment, the housing 2 and consequently also the switch contact chamber 3 extend in a longitudinal direction X, a transverse direction Y and a vertical direction Z which together define a Cartesian coordinate system. Substantially parallel with the vertical direction Z, there extends a longitudinal axis L of the switch element 1, and consequently also of the housing 2, which axis extends through a centre location M of an opening plane which extends in a vertical direction Z substantially at the height of the opening 5 or an edge 6 of the opening. An axial direction A of the switch element 1 or the housing 2 extends substantially parallel with the vertical direction Z. A switching direction S of the switch element 1 in which counter-contacts (not yet shown here) are joined together with the switch contacts 4 extends substantially counter to the vertical direction Z.

A positive-locking counter-element 7 in the form of a groove or a channel surrounds the opening 5. The positive-locking counter-element 7 extends substantially in an opening plane defined by the longitudinal direction X and transverse direction Y at the height of the centre location M of the opening 5. In a projection along the vertical direction Z, the positive-locking counter-element 7 has a substantially polygonal contour or a polygonal cross-section with rounded corners 8. Consequently, at a front side 9 of the housing 2 there are sufficient free faces provided in order to arrange in the region of corners 10 of the housing outside the contour of the positive-locking counter-element 7 auxiliary fixing means 11 which are constructed as shafts which extend substantially parallel with the vertical direction Z and which serve to receive fixing elements (not yet shown here) by means of which, for example, a component of a drive system (not yet shown here) can be secured to the housing 2 and can hold down a cover which is fitted thereto (not yet shown here).

In the region of the longitudinal sides of the housing 2 which extend substantially in the longitudinal direction X, protuberances 12 are formed in the contour of the positive-locking counter-element 7. In the region of the protuberances 12 there are formed within the contour of the positive-locking counter-element 7 support faces 13 which a cover which is placed on the housing 2 can abut. In the region of the protuberances 12, there are further formed auxiliary guiding means 14 in the form of shafts which extend substantially parallel with the vertical direction Z and which have in the direction towards the switch chamber 3 a passage 15 in the form of a slot which also extends substantially parallel with the vertical direction Z. Furthermore, a wall 16 of the housing surrounds the switch chamber 3 in the vertical direction Z below the opening 5. Counter to the vertical direction Z, the switch chamber 3 is delimited by a base 17 of the housing 2.

Figure 2:
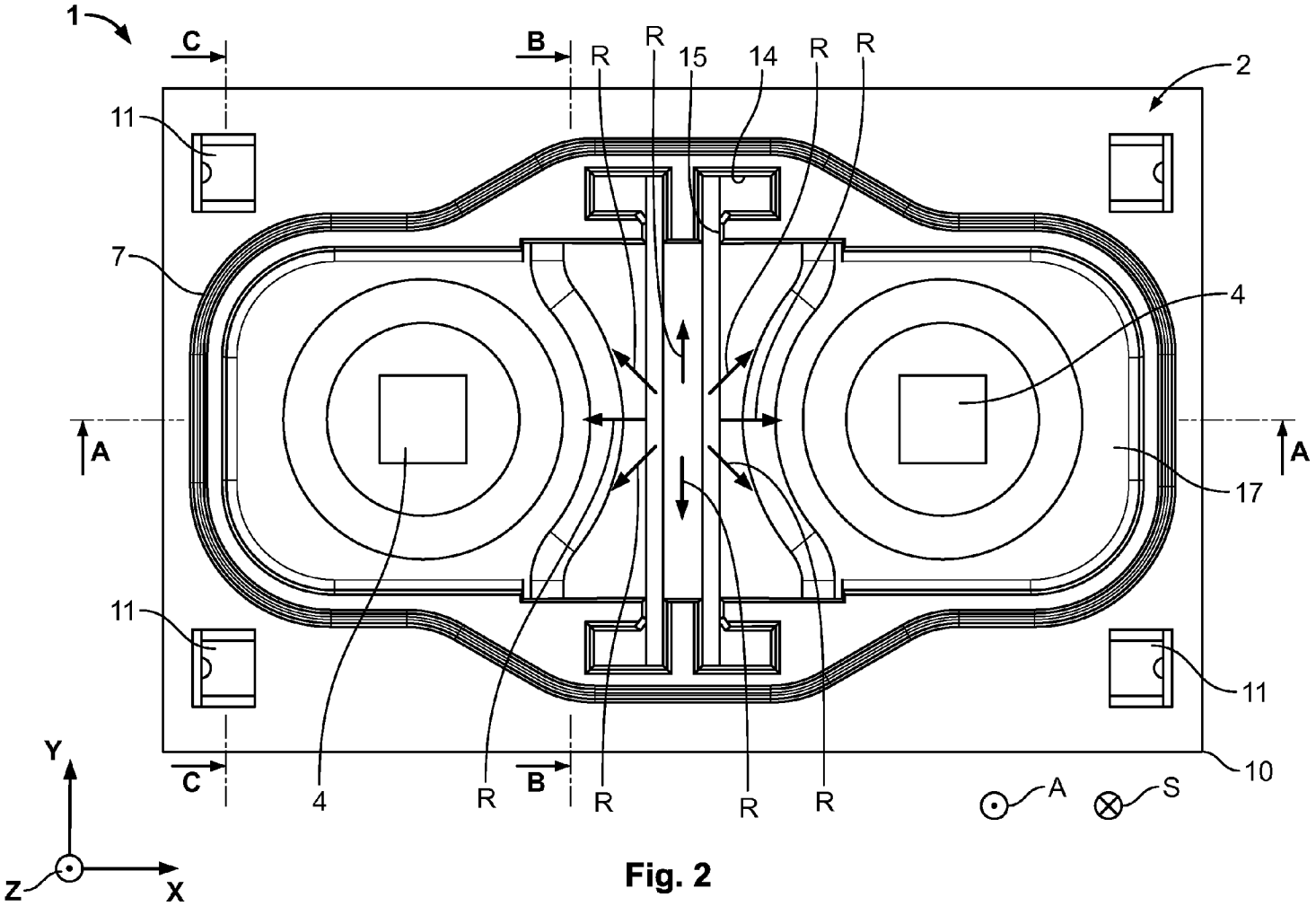
FIG. 2 is a plan view of the housing of FIG. 1.

FIG. 2 is a schematic plan view of the housing 2. Here, the rounded contour of the positive-locking counter-element 7 is particularly clear. In addition, it is shown how radial directions R of the switch element 1 and consequently of the housing 2 and the switch chamber 3 thereof extend radially away from the centre axis L or the centre location M.

The housing 2 may have any number of freely formed switch chambers 3, switch contacts 4, openings 5, edges 6, switch counter-contact elements 7, rounded corners 8, front sides 9, housing corners 10, auxiliary fixing means 11, protuberances 12, support faces 13, auxiliary guiding means 14, passage 15 and bases 17. The housing 2 can be constructed according to the invention as an injection-moulded component which can be produced in a simple and consequently cost-effective manner.

Figure 3:
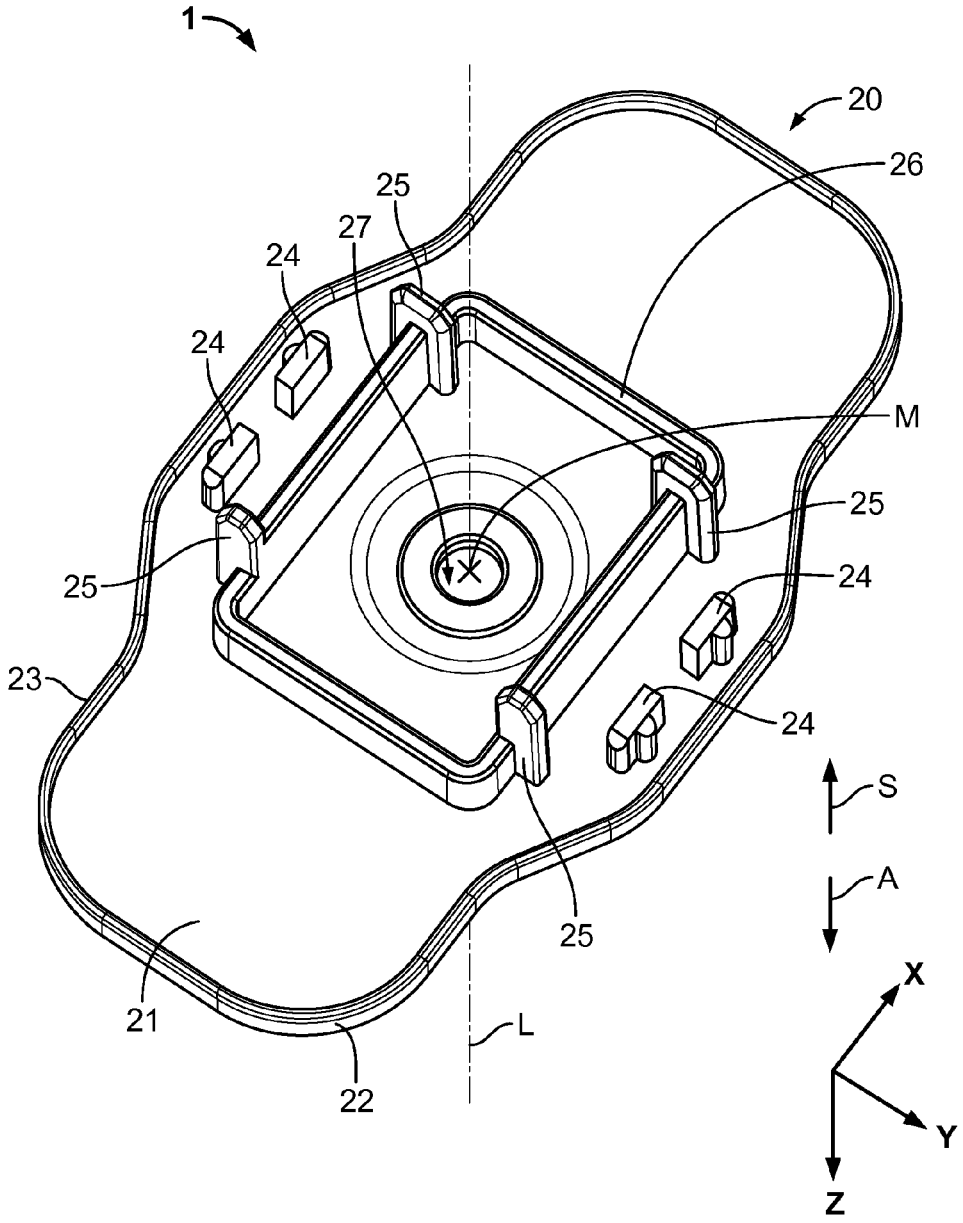
FIG. 3 is a perspective view of a cover for an electrical switch element according to the invention.

The cover 20 is shown in FIG. 3. The cover 20 has a covering region or a lid 21. At an outer edge 22 of the cover, a positive-locking element 23 which surrounds the covering region 21 is formed in the form of a sealing lip which extends around the covering region 21 and which extends substantially in a vertical direction Z away from and perpendicular to the covering region 21, or protrudes therefrom. The positive-locking element 23 terminates in a flush manner with the outer edge 22 and has in projection in the vertical direction Z or axial direction A a contour or a cross-section which substantially correspond(s) to the contour of the positive-locking counter-element 7. The positive-locking element 23 may have in the opening plane a round, oval and/or polygonal cross-section with rounded corners.

The covering region 21 also includes guiding elements 24 which extend substantially counter to the vertical direction Z, that is to say, perpendicularly away from the covering region 21, and which are constructed to engage in the auxiliary guiding means 14 of the housing. A height of the guiding elements 24 measured parallel with the vertical direction Z is greater than a height of the positive-locking element measured parallel with the vertical direction Z. That is to say, the guiding elements 24 protrude further from the covering region 21 than the positive-locking element 23.

There are further arranged on the covering region 21 additional guiding elements 25 and 25' which also extend away from the covering region 21 counter to the vertical direction Z and project beyond the positive-locking element 23 and the guiding elements 24 counter to the vertical direction Z. A second embodiment of the guiding elements 25' has a larger width measured in the transverse direction Y than a first embodiment of the guiding elements 25, whereby asymmetry of the additional guiding elements 25, 25' is produced, which can be used in order to define or to encode a correct orientation of the cover 20 with respect to the housing 2. Furthermore, the additional guiding elements 25, 25' are incorporated in a frame 26 or supported thereby. The frame 26 surrounds a passage 27 in the cover in the form of a circular opening through which an actuation member (not shown in FIG. 3) can be guided and moved in order to drive counter-contacts.

The cover 20 may have a covering region 21 which is configured in accordance with the respective requirements, or a lid, an outer edge 22, any number of positive-locking elements 23, guiding elements 24, additional guiding elements 25, 25', frame 26, passage 27 and upper cover sides 28. Guiding elements 24, 25, 25' may form first guiding faces 25*a* and second guiding faces 25 in accordance with respective requirements. The cover 20 can be constructed according to the invention as an injection-moulded component which can be produced in a simple and consequently cost-effective manner.

Figure 4:
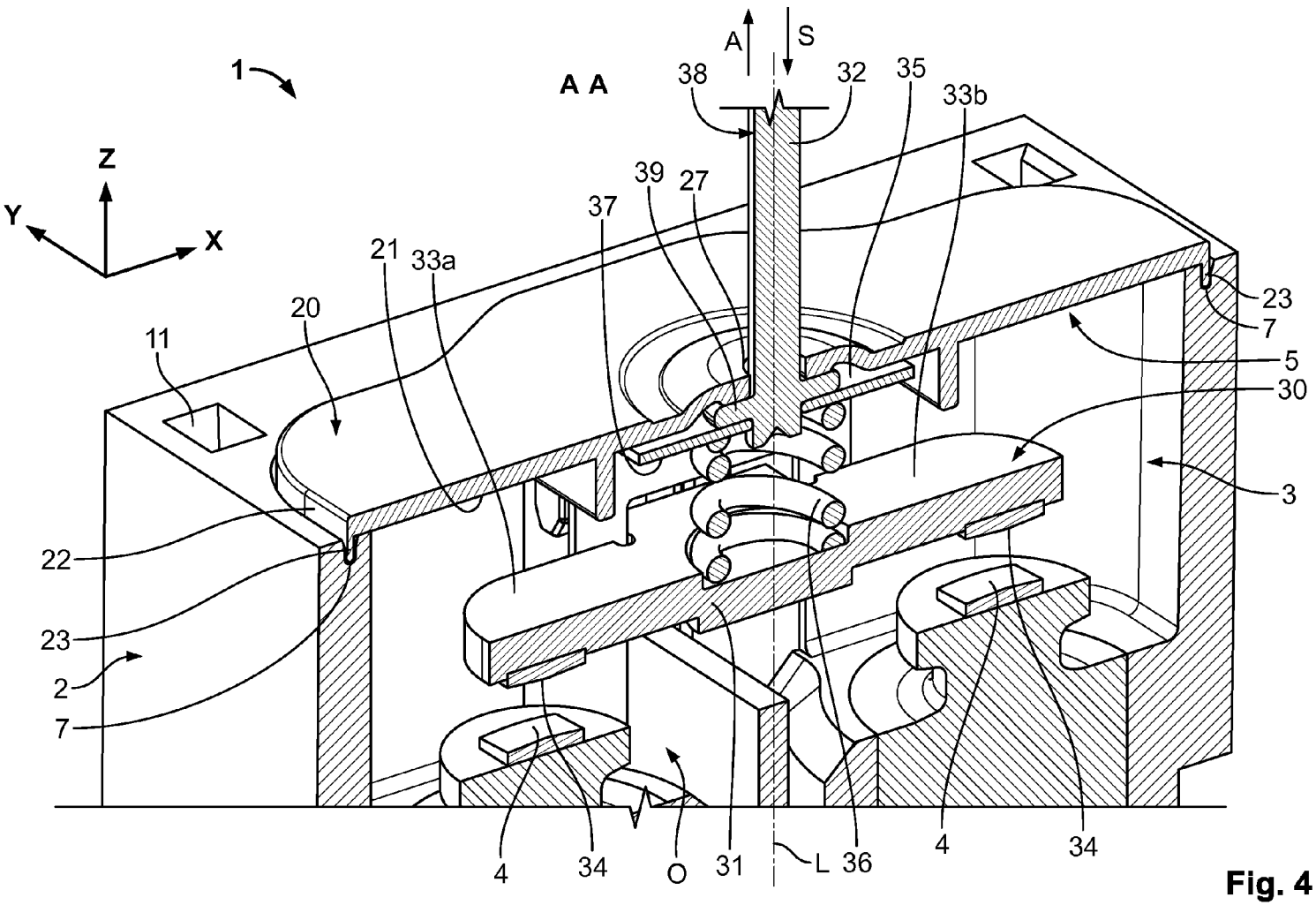
FIG. 4 is a cross-section of the housing shown in FIGS. 1 and 2 with the cover shown in FIG. 3, taken along the line of section A-A shown in FIG. 2.

The switch contact subassembly 30, as shown in FIG. 4, comprises a switch contact carrier 31 having two switch contact arms 33*a* and 33*b* which each carry a switch counter-contact 34. A contact bridge carrier 35 carries the switch contact bridge 31 which is supported via a resilient element 36 counter to the switching direction S on a securing base 37 of the contact bridge carrier 35 so that the switch contact bridge 30 is resiliently supported on the contact bridge carrier 35 counter to the switching direction S. As shown in FIG. 5, two retention members 35*a* and 35*b* extend substantially perpendicularly away from the securing base 37 of the contact bridge carrier 35. There is also secured to the securing base 37 an actuation member 38, shown in FIG. 4, which is supported via an annular collar 39 or flange in a switching direction S on the contact bridge carrier 35 and which has a shaft 32.

The switch contact subassembly 30 may be provided with any number of switch contact carriers 31, shafts 32, switch contact arms 33*a*, 33*b*, switch counter-contacts 34, contact bridge carriers 35, resilient elements 36, securing bases 37, securing members 38 and annular collars 39 which are configured in accordance with the respective requirements. The retention members 35*a*, 35*b* may be configured in accordance with the respective requirements in order to cooperate with guiding faces 25*a*, 25*b*.

The drive device 40, as shown in FIG. 7, has a yoke 41 which extends substantially in a plane which is defined by the longitudinal direction X and transverse direction Y. Two members 42*a* and 42*b* extend away from the yoke 41. At a side of the drive device 40 facing away from the yoke 41, a base plate 43 of the drive device 40 is retained between the members 42*a*, 42*b*. Fixing elements 45 are formed at the free member ends 44 of the members 42*a* and 42*b*, which ends are directed in the switching direction S. The fixing elements 45 are constructed, for example, as pins, mandrels or pegs and may have a large number of engagement elements 46, for example, in the form of teeth. The drive device 40 may be provided with any number of yokes 41, member base plates 43, free member ends 44, fixing elements 45 and engagement elements 46 configured in accordance with the respective requirements.

The assembly of the electrical switch element 1 will now be described primarily with reference to FIGS. 4 and 7.

FIG. 4 is a schematic, perspective cross-section of the switch element 1. The cover 20 is placed on the housing 2 counter to the axial direction A. The guiding elements 24 engage in the auxiliary guiding means 14 when the cover 20 is placed on the housing 2 before the positive-locking element 23 engages the positive-locking counter-element 7. The guiding elements 24 thus assist, when the switch element 1 is assembled, in joining the cover 20 together with the housing 2 in a rapid, simple and precise manner and thereby bringing the positive-locking element 23 into engagement with the positive-locking counter-element 7. Consequently, the opening 5 of the housing 2 is closed and the switch chamber 3 is delimited in the axial direction A by the covering region 21 of the cover 20.

Figure 6:
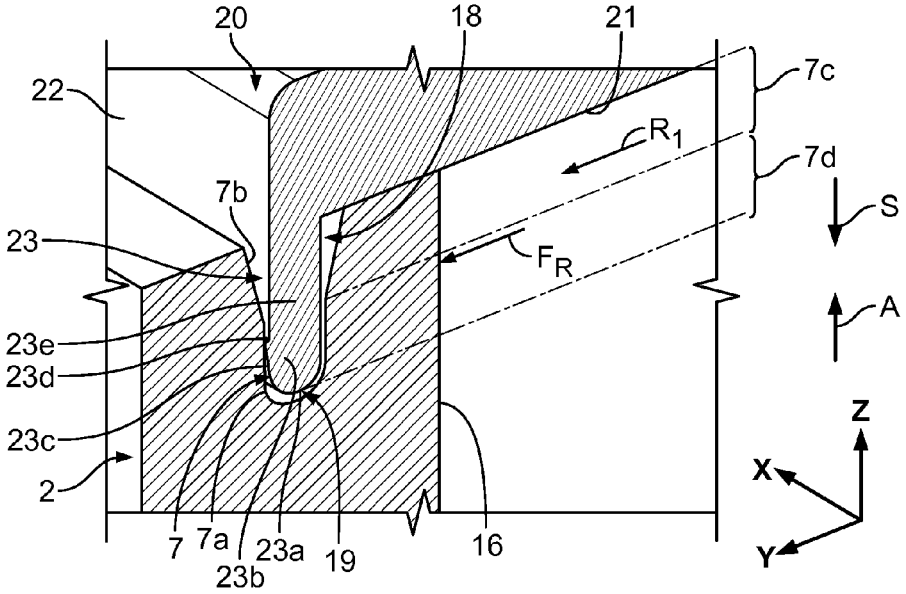
FIG. 6 is a cross-section of the housing shown in FIGS. 1 and 2 with the cover shown in FIG. 3.

FIG. 6 is a schematic perspective cross-section of the positive-locking element 23 which is inserted into the positive-locking counter-element 7. This shows that at a free end 23*a* of the positive-locking element 23 directed counter to the axial direction A or vertical direction Z there is formed a bead 23*b* which has or forms an inclined introduction member 23*c* and a terminal edge which is directed away from the free end 23*a*. The bead 23*b* is connected to the cover 20 by means of a rib contour 23*e* which is narrower compared with the width of the bead 23*b* measured in the transverse direction Y. The bead 23*b* can thus be resiliently redirected counter to the longitudinal direction X and transverse direction Y.

The free end 23*a* is arranged with spacing from a base 7*a* of the positive-locking counter-element 7 in a vertical direction Z or axial direction A. Side walls 7*b* of the positive-locking element 7 are constructed in such a manner that they are spaced apart in the upper portion 7*c* from the positive-locking element 23 and are in abutment in a lower portion 7*d* substantially with the positive-locking element 23 or in particular the bead 23*b* thereof. In the upper portion 7*c* there is consequently an upper free space 18 or receiving space in which the positive-locking element 23 is spaced apart from the positive-locking counter-element 7 in a radial direction R. Below the free end 23*a* of the positive-locking element 23, a lower free space 19 or receiving space is formed between the positive-locking element 23 and the positive-locking counter-element 7. The free spaces 18 and 19 may, for example, receive sealing and/or adhesive masses or materials. A height of the upper portion 7*c* measured in an axial direction A or vertical direction Z may substantially correspond to a height of the lower portion 7*d* measured in an axial direction A or vertical direction Z. Consequently, in the lower portion 7*d*, there may be a positive and/or non-positive-locking connection between the positive-locking element 23 and the positive-locking counter-element 7. The positive and/or non-positive connection may be stabilised by means of adhesive and/or filling and/or cast materials located in the free spaces 18 and 19 and the tightness of the use between the cover 20 and housing 2 can consequently be increased.

FIG. 6 further shows that radial forces FR which act in a radial direction R and which act on the wall 16 of the housing 2 are transmitted via the positive-locking counter-element 7 to the positive-locking element 23 since they overlap each other in a radial direction R. Radial forces FR can consequently be introduced into the covering region 21 of the cover 20 which consequently stabilises the housing opening 5 or prevents the wall 16 from being displaced in a radial direction R relative to the cover 20 or the opening 5 being expanded. Consequently, in particular pressure shocks brought about by the formation of an electric arc can be mechanically absorbed and relative movements between the cover 20 and housing 2 can be prevented.

The switch contact subassembly 30, as shown in FIG. 4, is arranged in the switch chamber 3. The shaft 32 protrudes through the passage 27 in the housing cover 20. The switch counter-contacts 34 are arranged so as to be opposite the switch contacts 4 in the switching direction S and are retained with spacing from the switch contacts 4 in the open state O of the switch element 1 shown in FIG. 4. In a closed state C (not shown), the switch counter-contacts 34 are in contact with the switch contacts 4 in an electrically conductive manner. A switching force FS, which extends substantially in a switching direction S, can be transmitted to the switch contact carrier 31 via the shaft 32 in order to bring the switch counter-contacts 34 into contact with the switch contacts 4. To this end, the switch contact bridge 31 is lowered in the switching direction S.

As shown in FIG. 5, the retention members 35*a*, 35*b* extend substantially parallel with the switching direction S and are guided counter to or in the transverse direction Y by the guiding elements 25. The guiding elements 25 each form a first guiding face 25*a* and second guiding face 25*b*. The first guiding face 25*a* faces the wall 16 of the housing 2. The second guiding face 25*b* faces the retention members 35*a* or 35*b* of the switch contact subassembly 30. Consequently, the guiding elements 25, 25' perform a dual function, on the one hand, by supporting the cover 20 in or counter to the transverse direction Y on the wall 16 of the housing 2 and, on the other hand, guiding the contact bridge carrier 35 of the switch contact subassembly 30 substantially parallel with the switching direction S.

FIG. 7 shows the cover 20 placed on the housing 2, a switch contact subassembly 30 located in the switch chamber 3 and the drive device 40 placed on the cover 20.

The fixing elements 45 extend substantially counter to the vertical direction Z or axial direction A, that is to say, in the switching direction S away from the free ends 44, and are received in the auxiliary fixing means 11 of the housing 2. The fixing elements 45 can engage in the wall of the shaft-like auxiliary fixing means 11 and consequently assist in improving a positive-locking and/or non-positive-locking connection between the auxiliary fixing means 11 and the fixing elements 45. The cover 20 may be enclosed in a state below the base plate 43 between the base plate 44 and the support faces 3 of the housing 2. The base plate 43 may be held down by the free member ends 44. The cover 20 can consequently be secured to the housing 2.

Figure 8:
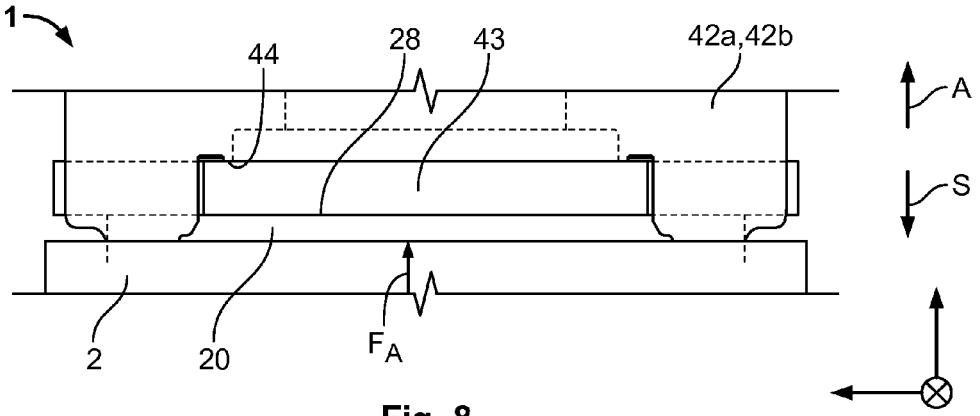
FIG. 8 is a side detail view of a portion of FIG. 7.

FIG. 8 shows the cover 20 enclosed between the housing 2 and base plate 43. This shows that the free member end 44 presses down the base plate 43 which is in planar abutment with an upper side 28 of the cover 20 and consequently prevents bulging of the cover in an axial direction A. Axial forces $F_A$ acting on the cover 20 in an axial direction A can consequently be introduced via the base plate 43, the free member end 44, the members 42*a*, 42*b* and the fixing elements 45 into the auxiliary fixing means 11 of the housing 2. Consequently, any axial forces such as, for example, switching forces, when closing or opening the contacts or explosion forces of the extinguishing electric arc which substantially act in an axial direction, can be transmitted directly from the housing to the punched/bent component of the drive system, without subjecting the positive-locking element and positive-locking counter-element to loads.

The switch element 1 consequently has a compact and robust structure in which radial forces $F_R$ and axial forces $F_A$ acting both on the cover 20 and on the housing 2 can be absorbed in a reliable manner without the housing 2 or cover 20 becoming deformed, whereby a high level of sealing of the switch chamber 3 can be ensured.

What is claimed is:

1. An electrical switch element, comprising:

a housing having a switch chamber, an opening to the switch chamber, electrical switch contacts arranged in the switch chamber, and a positive-locking counter-element extending completely around the opening; and a cover having a positive-locking element extending completely around the opening and engaging the at least one positive-locking counter-element, the positive-locking element is a lip extending perpendicularly with respect to the cover and having a bead formed at a free end of the lip and a rib contour connecting the bead to the cover, a thickness of the rib contour is less than a thickness of the bead, the cover extending over the opening and the rib contour spaced apart from the positive-locking counter-element.

2. The electrical switch element according to claim 1, wherein the positive-locking element engages the positive-locking counter-element in a plane of the opening.

3. The electrical switch element according to claim 2, wherein the positive-locking element is disposed on an outer edge of the cover.

4. The electrical switch according to claim 3, wherein the positive-locking counter-element is formed as a recess.

5. The electrical switch according to claim 4, wherein the positive-locking counter-element is spaced apart from an edge of the opening.

6. The electrical switch according to claim 1, wherein the bead abuts the positive-locking counter-element.

7. The electrical switch according to claim 1, wherein the cover has at least one guiding element.

8. The electrical switch according to claim 7, wherein the at least one guiding element projects beyond the positive-locking element.

9. The electrical switch according to claim 8, wherein the housing has auxiliary guiding means engaging the at least one guiding element.

10. The electrical switch according to claim 1, further comprising a switch contact subassembly having a switch contact carrier, a retention member, and a shaft.

11. The electrical switch according to claim 10, wherein the switch contact carrier is disposed within the opening and the shaft protrudes through the cover.

12. The electrical switch according to claim 11, wherein the cover has at least one guiding element engaging the retention member.

13. The electrical switch according to claim 1, wherein an upper receiving space is positioned between the rib contour and the positive-locking counter-element, a sealing or an adhesive positioned in the upper free space.

14. An electrical switch element, comprising:

a housing having a switch chamber, an opening to the switch chamber, electrical switch contacts arranged in the switch chamber, and a positive-locking counter-element extending completely around the opening; and a cover extending over the opening and having a positive-locking element extending completely around the opening and engaging the at least one positive-locking counter-element, the positive-locking element is a lip extending perpendicularly with respect to the cover and having a bead formed at a free end of the lip, and a guiding element disposed on the cover within the positive-locking element and projecting beyond the positive-locking element.

15. The electrical switch according to claim 14, wherein the housing has an auxiliary guiding means engaging the guiding element.

16. The electrical switch according to claim 15, wherein the housing has a wall surrounding the switch chamber.

17. The electrical switch according to claim 16, wherein the auxiliary guiding means is positioned on a side of the wall opposite the switch chamber.

18. The electrical switch according to claim 17, wherein the auxiliary guiding means is a shaft extending into the housing perpendicular to a plane of the opening.

19. The electrical switch according to claim 18, wherein the wall has a passage communicating between the auxiliary guiding means and the switch chamber.

* * * * *